US005556140A

United States Patent [19]

Sakagami

[11] Patent Number: 5,556,140

[45] Date of Patent: Sep. 17, 1996

[54] DOOR HANDLE ASSEMBLY WITH EMERGENCY-UNLOCKING FUNCTION

[75] Inventor: Kouichi Sakagami, Tokyo, Japan

[73] Assignee: Takigen Manufacturing Co. Ltd., Tokyo, Japan

[21] Appl. No.: 191,809

[22] Filed: Feb. 3, 1994

[30] Foreign Application Priority Data

Mar. 1, 1993 [JP] Japan ..... 5-013636 U

[51] Int. Cl.[6] ..... E05B 65/10; E05B 15/02

[52] U.S. Cl. ..... 292/92; 292/341.17

[58] Field of Search ..... 292/146, 153, 292/341.15, 341.17, 92, 340, DIG. 65, 92; 49/141

[56] References Cited

U.S. PATENT DOCUMENTS

| | | | |
|---|---|---|---|
| 875,338 | 12/1907 | Foery | 292/153 |
| 2,747,906 | 5/1956 | Emmert | 292/92 |
| 2,772,110 | 11/1956 | Petrochko | 292/92 |
| 2,782,061 | 2/1957 | Borchers et al. | 292/153 |
| 4,181,338 | 1/1980 | Sterling | 292/341.17 |
| 4,202,573 | 5/1980 | Berkowitz et al. | 292/223 |
| 4,893,855 | 1/1990 | Itakura | 292/341.17 |
| 5,149,157 | 9/1992 | Laugery et al. | 292/341.16 |

FOREIGN PATENT DOCUMENTS

| | | | |
|---|---|---|---|
| 696057 | 8/1953 | United Kingdom | 292/153 |

*Primary Examiner*—Peter M. Cuomo
*Assistant Examiner*—Tuyet-Phuong Pham
*Attorney, Agent, or Firm*—Martin Smolowitz

[57] ABSTRACT

A door handle assembly has an emergency-unlocking function, so that even in a condition in which a latch bar 2 of the assembly is locked on a front side of a door 4, it is possible for a user to unlock the assembly from a rear side of the door 4 within fail. A socket member 8 is pivoted to a socket-member casing 6 through a vertical pivot 9, the casing 6 being fixedly mounted on a stationary frame element 7. In the rear side of the casing 6, a manually-operated pedal 12 is pivoted to a pedal casing 11 through a first horizontal pivot 13, the pedal casing 11 being fixedly mounted on the frame element 7. A base-end portion of a holding rod 14 is pivoted to one end portion of the pedal 12 through a second horizontal pivot 15 to have a front-end surface of the rod 14 abutted on a stop portion 19 of the socket member 8, the stop portion 19 being disposed behind the pivot 9. The rod 14 is urged forward by a spring 20 contacting the pedal 12.

5 Claims, 5 Drawing Sheets

DOOR HANDLE ASSEMBLY WITH EMERGENCY-UNLOCKING FUNCTION

BACKGROUND OF THE INVENTION

1. Field of the Invention

The present invention relates to a door handle assembly with an emergency-unlocking function, the assembly being used in a door and the like between a crew's room and a passenger's room of an electric railcar.

2. Description of the Prior Art

In a conventional railcar, when rail car accidents such as derailment and fires happen, an emergency lock is operated to open passenger doors so as to permit passengers in the railcar to escape therefrom. In order to facilitate the passengers' escape, it has been already proposed to open the doors of the crew's rooms too under such circumstances.

When the passengers escape from the doors of the crew's rooms, it is necessary to open doors between the crew's rooms and the passenger's rooms in emergency cases. On the other hand, in normal cases, due to the necessities of taking safety and operating precautions in practice, it is necessary to prevent the passengers from entering the crew's rooms by locking the doors of the crew's rooms.

These doors of the crew's rooms are normally unlocked inside the crew's rooms. However, when the crews are seriously injured by accidents to such an extent that they can not unlock the doors of the crew's rooms, it is necessary to unlock these doors by someone in the passenger's rooms.

SUMMARY OF THE INVENTION

It is an object of the present invention to provide a door handle assembly with an emergency-unlocking function, which enables a user or passenger to unlock a door by operating a manually-operated pedal disposed behind the door, even when the door is in its locked condition in which a latch bar of the assembly is locked by a lock in a front side of the door.

The above object of the present invention is accomplished by providing:

a door handle assembly with an emergency-unlocking function, comprising:

a handle unit fixedly mounted on a door, the handle unit being operated by swingably operating a handle to slidably move a latch bar back and forth;

a lock for preventing the handle from being swingably operated and for preventing the latch bar from slidably moving back and forth, the lock being fixedly mounted on the handle unit;

a socket-member casing for receiving a front-end portion of the latch bar therein is fixedly mounted on a stationary frame element;

a socket member which is engageable with and disengageable from the front-end portion of the latch bar is pivoted to side walls of the socket-member casing through a vertical pivot so as to be swingable back and forth;

a pedal casing fixedly mounted on the stationary frame element behind the socket-member casing;

a manually-operated pedal pivoted to the pedal casing through a first horizontal pivot;

a holding rod having its base-end portion pivoted to one end portion of the manually-operated pedal through a second horizontal pivot, the manually-operated pedal being provided with a depressing portion in its another end portion which is diametrically opposed to the one end portion on the first horizontal pivot, the holding rod perpendicularly penetrating the stationary frame element and having its front-end surface abutted against a stop portion of the socket member, the stop portion being provided behind the vertical pivot; and a spring for biasing the holding rod into the socket-member casing in a slidable manner, the spring being disposed between the pedal casing and the manually-operated pedal.

DESCRIPTION OF THE PREFERRED EMBODIMENTS

Figure 1:
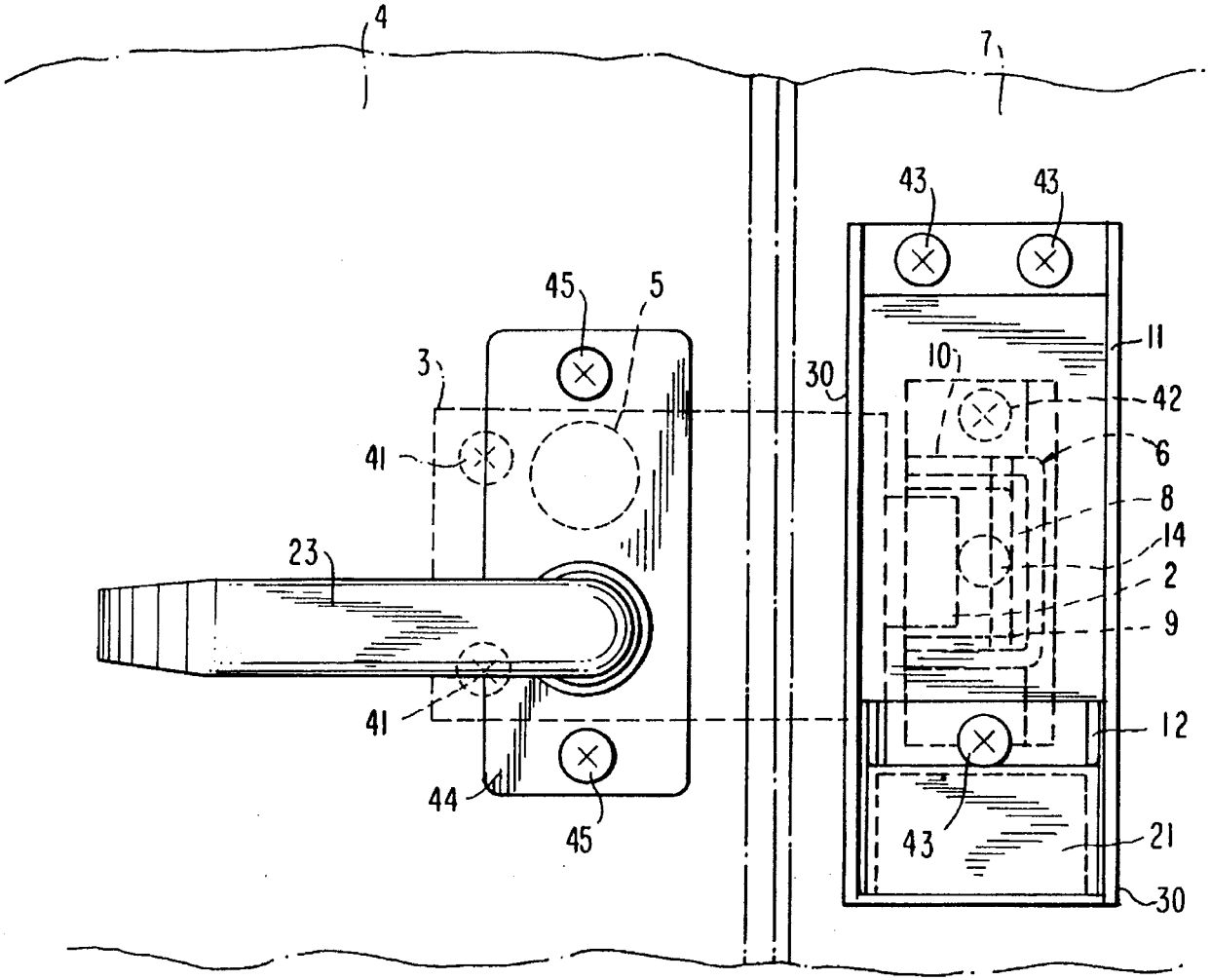
FIG. 1 is a rear view of a door between the crew's room and a passenger's room of an electric railcar, the door being provided with an embodiment of the door handle assembly of the present invention with the emergency-unlocking function.
Figure 2:
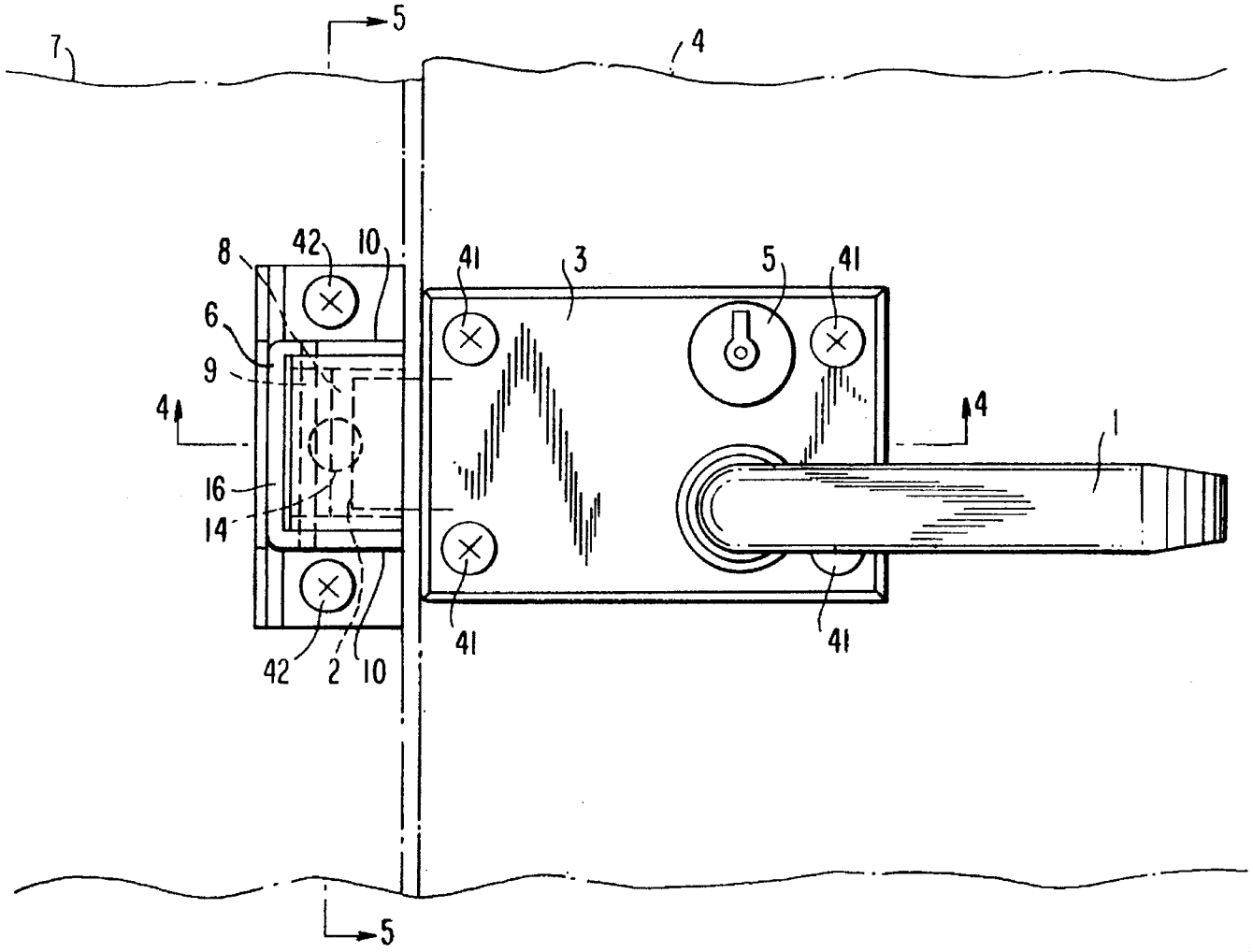
FIG. 2 is a front view of the door handle assembly shown in FIG. 1 in its locked condition.
Figure 3:
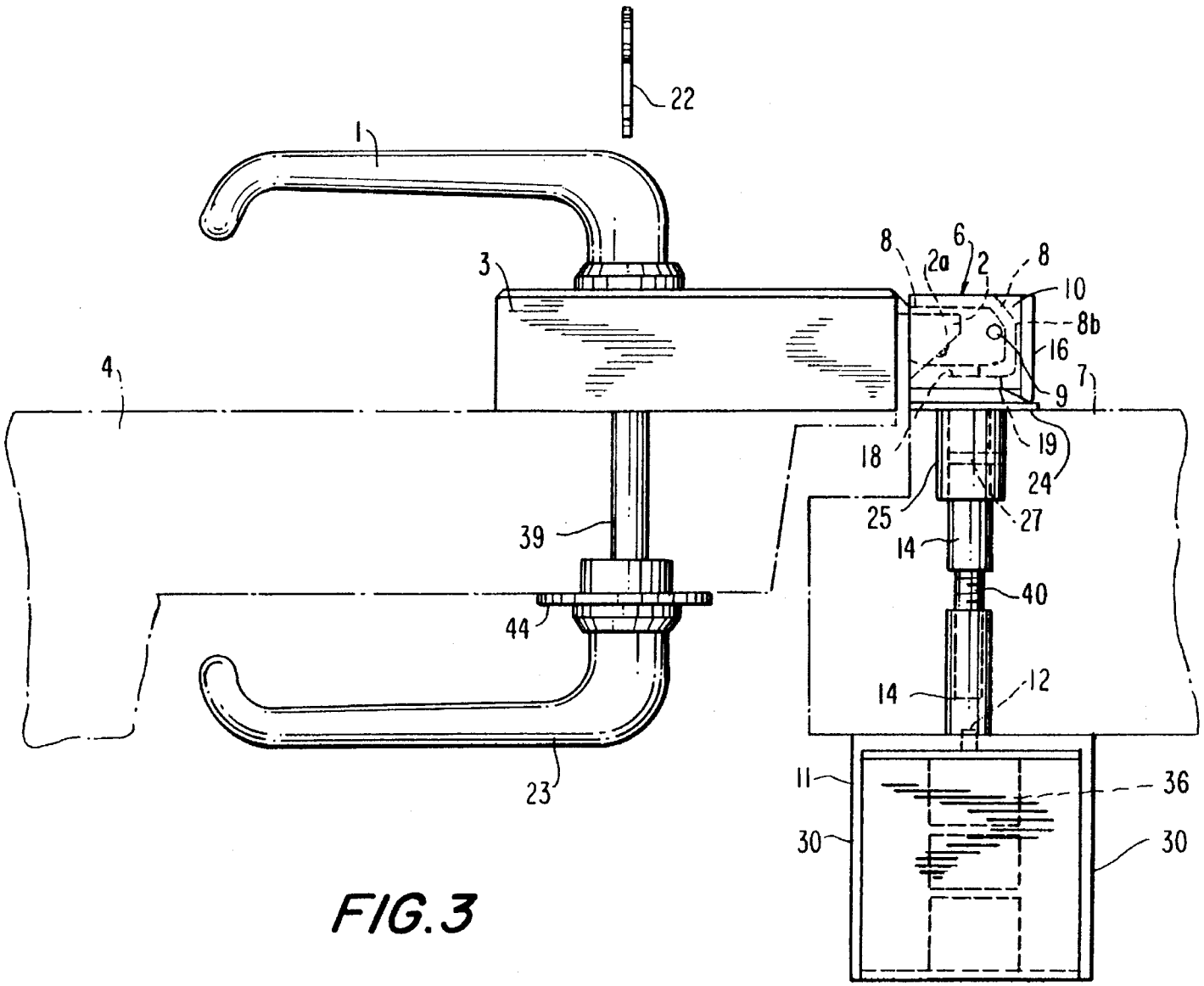
FIG. 3 is a plan view of the door handle assembly shown in FIG. 1 in its locked condition.
Figure 4:
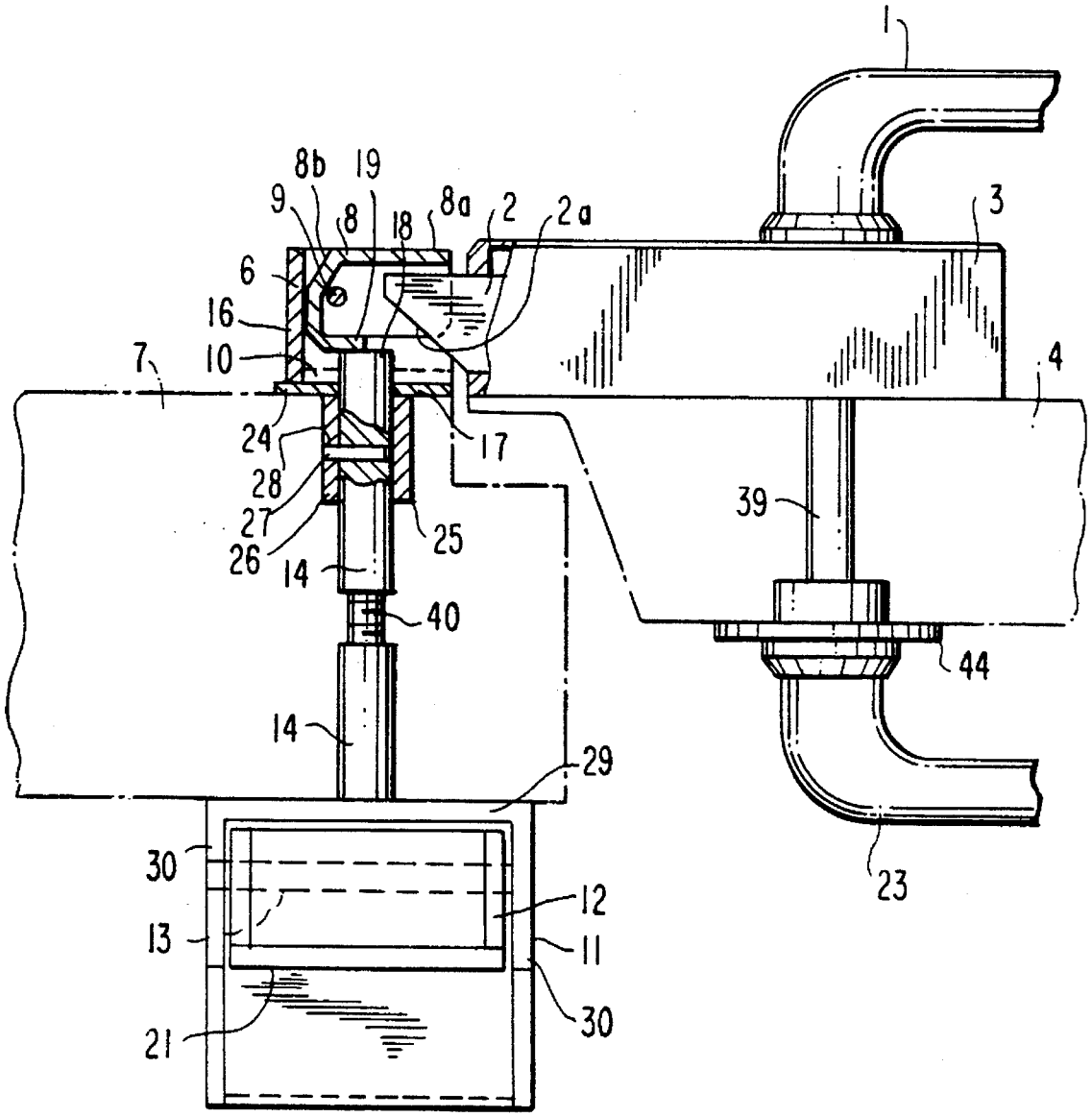
FIG. 4 is a cross-sectional view of the door handle assembly, taken along the line 4—4 of FIG. 2.
Figure 5:
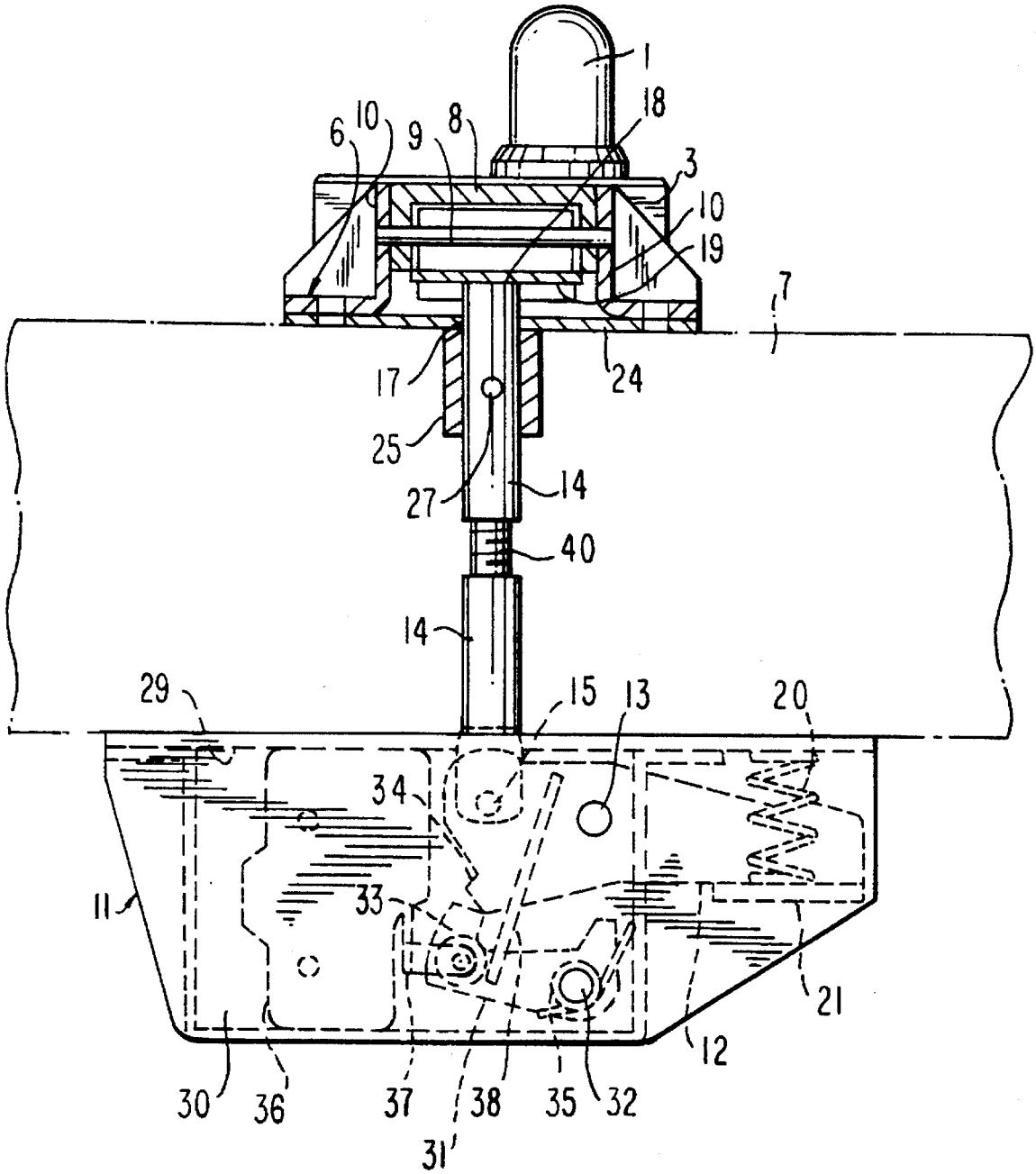
FIG. 5 is a cross-sectional view of the door handle assembly, taken along the line 5—5 of FIG. 2.

Hereinbelow, the present invention will be described in detail with reference to the accompanying drawings and the reference numerals and characters.

In a door handle assembly with an emergency-unlocking function according to the present invention, a handle unit 3 is fixedly mounted on a door 4. The handle unit 3 is operated by swingably operating a handle 1 to slidably move a latch bar 2 back and forth. Fixedly mounted on the handle unit 3 is a lock 5 for preventing the handle 1 from being swingably operated and for preventing the latch bar 2 from slidably moving back and forth. A socket-member casing 6 for receiving a front-end portion of the latch bar 2 therein is fixedly mounted on a stationary frame element 7. A socket member 8, which is engaged with and disengaged from the front-end portion of the latch bar 2, is pivoted to side walls 10 of the socket-member casing 6 through a vertical pivot 9, so as to be swingable back and forth. A pedal casing 11 is fixedly mounted on the stationary frame element 7 behind the socket-member casing 6. A manually-operated pedal 12 is pivoted to the pedal casing 11 through a first horizontal pivot 13.

A holding rod 14 has its base-end portion pivoted to one end portion of the manually-operated pedal 12 through a second horizontal pivot 15. The manually-operated pedal 12 is provided with a depressing portion 21 in another end portion which is diametrically opposed to the one end portion on the first horizontal pivot 13. The holding rod 14 perpendicularly penetrates the stationary frame element 7 and has its front-end surface 18 abutted against a stop portion 19 of the socket member 8. The stop portion 19 is provided behind the vertical pivot 9. A hook-biasing spring 20 for biasing the holding rod 14 into the socket-member casing 6 in a slidable manner is interposed between the pedal casing 11 and the manually-operated pedal 12.

When the door handle assembly of the present invention is employed in the door 4 between the crew's room and the passengers' room, the door 4 is locked by the use of the lock 5 under the necessity of taking safety and operating precautions in normal operation practice. In the thus locked door 4, the holding rod 14 has its front-end surface 18 abutted against the stop portion 19 of the socket member 8 to prevent the same member 18 from swinging on the vertical pivot 9.

In the case that a crew member inside the crew's room opens the door 4, he turns the key 22 having been inserted in the lock 5 to unlock the handle 1 so as to permit the same 1 to swing. When the handle 1 is swung, the thus swung handle 1 slidably moves the latch bar 2 back and forth through an interlocking mechanism in the handle unit 3 so as to have the front-end portion of the latch bar 2 be free from the socket-member casing 6, whereby the latch bar 2 is disengaged from the socket member 8. As a result, the door 4 is unlocked from the stationary frame element 7 so that the crew member can open the door 4 by pulling the handle 1 forward.

In the case that the passenger inside the passenger's room opens the door 4, he pushes the depressing portion 21 of the manually-operated pedal 12 to swing the same pedal 12 on the first horizontal pivot 13. As a result, since the holding rod 14 is pulled toward a rear side of the door 4, the front-end surface 18 of the holding rod 14 is separated from the stop portion 19 of the socket member 8 by a predetermined distance. Consequently, the socket member 8 becomes swingable on the vertical pivot 9.

Under such circumstances, when the passenger pushes the door 4 toward the crew's room, since the front-end portion of the latch bar 2 pushes the socket member 8 on its rear surface side, the socket member 8 swings forward on the vertical pivot 9 so that the latch bar 2 is disengaged from the socket member 8. Therefore, the door 4 is disengaged from the stationary frame element 7 to open, whereby the passenger can escape through the thus opened door 4.

When the manually-operated pedal 12 is released from the passenger's hand, the pedal 12 returns to its normal waiting position under the influence a resilient force exerted by the hook-biasing spring 20, so that the holding rod 14 slidably moves forward to have its front-end surface 18 projected to return to a predetermined position inside the socket-member casing 6. When the door 4 is closed, since the front-end portion of the latch bar 2 abuts against the socket member 8 at the last stage of the door closing operation, the socket member 8 is pushed into the socket-member casing 6 so that the stop portion 19 of the socket member 8 returns to a position in which its stop portion 19 abuts against the front-end surface 18 of the holding rod 14.

The latch bar 2 has its front-end oblique cam surface **2*a* brought into a slidable contact with the end-edge portion 8*a* of the socket member 8, so that the latch bar 2 temporarily moves back in a slidable manner. Immediately after the door 4 is closed so that the latch bar 2 has its front-end portion reach the rear-surface side of the end-edge portion 8*a* of the socket member 8, the latch bar 2 is slidably projected under the influence of a resilient force exerted by a spring (not shown) incorporated in the handle unit 3, so that the latch bar 2 is engaged again with the socket member 8, whereby the door 4 is locked to the stationary frame element 7**.

In the embodiment shown in the drawings, the door handle assembly of the present invention is applied to the door 4 between the crew's room and the passenger's room. Consequently, in this case, the handle 23 for operating the interlocking mechanism provided inside the handle unit 3 is provided in the passenger's room. Such interlocking mechanism of the handle unit 3 is constructed of, for example: a cam disc which is provided with a square receiving hole (in which a corresponding-square rotatable shaft 39 of the handle 1 is inserted) in its central portion and a drive pin in its eccentric position, the drive pin projecting from the cam disc; a sliding plate which is connected with the base-end portion of the latch bar 2 and provided with a receiving slot in which the drive pin is inserted; and, a spring for urging the latch bar 2 to return to its projecting position. The rotating shaft 39 of the handle 1 disposed in the passenger's room side is inserted in the square hole of the cam disc. Such interlocking mechanism may be any one of conventional types of mechanisms.

The socket-member casing 6 has it's front side be fully opened so that the front-end portion of the holding rod 14 is inserted into the socket-member casing 6 through the through-hole 17 of the base plate 24 of the socket-member casing 6. The holding rod 14 has its entire length adjusted by the use of an intermediate-connecting bolt 40 so as to correspond to the width of the stationary frame element 7. Fixedly mounted on a rear-surface side of the base plate 24 of the socket-member casing 6 is a guide sleeve 25 which is provided with an axial groove 26 in which a limit pin 27 projecting from the side surface of the holding rod 14 is inserted. When the limit pin 27 abuts against a bottom surface 28 of the axial groove 26, the front-end surface 18 of the holding rod 14 is abutting against the stop portion 19 of the socket member 8 so that the socket member 8 is holding within the socket-member casing 6. When the socket member 8 swings forward so that the latch bar 2 is released from the socket member 8, a stop-surface portion **8*b* of the socket member 8 abuts against the end-surface wall 16 of the socket-member casing 6**.

The hook-biasing spring 20 for resiliently advancing the holding rod 14 is constructed of a compression coil spring interposed between the depressing portion 21 of the manually-operated pedal 12 and the base plate 29 of the pedal casing 11. The manually-operated pedal 12 is pivoted to side walls of the pedal casing 11 through the first horizontal pivot 13. Further pivoted to the side walls 30 through a third horizontal pivot 32 is a base-end portion of a keeping lever 31 which is provided with an engaging projection 33 in its front-end portion. On the other hand, the manually-operated pedal 12 is provided a corresponding projection 34 in its one end portion.

The keeping lever 31 is so biased by a coil spring 35 as to have its engaging projection 33 abutted against the corresponding projection 34 of the manually-operated pedal 12. Namely, the coil spring 35 has its coil portion mounted on the third horizontal pivot 32 in an insertion manner, one of its opposite linear portions abutted against the pedal casing 11 and the other of its opposite linear portions abutted against the keeping lever 31. Provided inside the pedal casing 11 is a microswitch 36 connected with an actuating circuit of an alarm (not shown). Fixedly mounted on the manually-operated pedal 12 is a switch-operating plate 38 which pushes an actuator lever 37 of the microswitch 36.

When the manually-operated pedal 12 is depressed by a predetermined amount so that the holding rod 14 is pulled by a predetermined distance, the engaging projection 33 of the keeping lever 31 engages with the receiving projection 34 of the manually-operated pedal 12 to maintain the same pedal 12 in its depressed position. In addition, since the switch-operating plate 38 pushes the actuator lever 37 of the microswitch 36 when the manually-operated pedal 12 is depressed by the predetermined amount, an alarm is actuated to issue an alarming voice or sound, or to turn on an alarming lamp anti the like, which notifies the crew member that the door 4 is already unlocked and he is free from his duty to unlock the door 4.

When it is judged from circumstances that such unlocking of the door 4 is done by the passenger's mistake or tampering, the crew member may operate the keeping lever 31 to disengage its engaging projection 33 from the receiving projection 34 of the manually-operated pedal 12 so as to permit the pedal 12 to return to its initial or waiting position and also permit the holding rod 14 to slidably move forward, and, thereafter, the crew may close and lock the door 4. The handle unit 3 is fixedly mounted onto the door 4 front side by screw fasteners 41, and unit 44 is attached onto the door 4 rear side by screw fasteners 45. The handle 23 includes bearing flange member 44 provided against the rear side of the door 4. Also, the pedal casing 11 is attached onto the stationary frame element 7 by screw fasteners 43.

In the present invention having the above construction: the socket member 8 is pivoted to the socket-member casing 6 through the vertical pivot 9, the socket-member casing 6 being fixedly mounted on the stationary frame element 7; the manually-operated pedal 12 is pivoted to the pedal casing 11 through the first horizontal pivot 13, the pedal casing 11 being fixedly mounted on the stationary frame element 7 behind the socket-member casing 6; and, the holding rod 14 has its base-end portion pivoted to the one end portion of the manually-operated pedal 12 through the second horizontal pivot 15, and has its front-end surface 18 abutted against the stop portion 19 of the socket member 8 disposed behind the vertical pivot 9. Consequently, even in a condition in which the door 4 is locked in the crew's room by the use of the lock 5 with which the latch bar 2 is prevented from moving, it is possible for the passengers inside the passengers' room to unlock and open the door 4 without fall by disengaging the holding rod 14 from the socket member 8 by the use of the manually-operated pedal 12.

What is claimed is:

1. A handle assembly with an emergency-unlocking function, comprising:

a handle unit (3) fixedly mounted on a door (4), said handle unit (3) being operated by swingably operating a handle (1) to slidably move a latch bar (2) back and forth;

a lock (5) for preventing said handle (1) from being swingably operated and for preventing said latch bar (2) from slidably moving back and forth, said lock (5) being fixedly mounted in said handle unit (3);

a socket-member casing (6) for receiving a front-end portion of said latch bar (2) therein said socket-member casing (6) being fixedly mounted on a stationary frame element (7);

a socket member (8) which is engagable with and disengageable from said front-end portion of said latch bar (2) and which is pivoted to side walls (10) of said socket-member casing (6) through a vertical pivot (9) so as to be swingable back and forth;

a pedal casing (11) fixedly mounted on said stationary frame element (7) behind said socket-member casing (6);

a manually-operated pedal (12) pivoted to said pedal casing (11) through a first horizontal pivot (13);

a holding rod (14) having its base-end portion pivoted to one end portion of said manually-operated pedal (12) through a second horizontal pivot (15), said manually-operated pedal (12) being provided with a depressing portion (21) in its another end portion which is diametrically opposed to said one end portion on said first horizontal pivot (13), said holding rod (14) perpendicularly penetrating said stationary frame element (7) and having its front-end surface (18) abutted against a stop portion (19) of said socket member (8), said stop portion (19) being provided behind said vertical pivot (9); and a spring (20) for biasing said pedal (12) and said holding rod (14) into said socket-member casing (6) in a slidable manner, said spring (20) being disposed between said pedal casing (11) and said manually-operated pedal (12), whereby the door (4) can be opened by depressing the manually-operated pedal (12) pivoted at (15) and thereby withdrawing said holding rod (14) from contact with the stop portion (19) of said socket member (8).

2. The door handle assembly of claim 1, including a handle (23) mounted on the opposite side of said door (4) and connected to said handle unit (3) by a rotatable shaft (39) extending through the door (4).

3. The door handle assembly of claim 1, wherein said manually-operated pedal 12 includes a fixedly-mounted plate (38) which pivotably contacts a microswitch (36) which can be actuated by said manually-operated pedal (12) to open the door (4).

4. The door handle assembly of claim 1, wherein said manually-operated pedal (12) includes a projection (34) which contacts an engaging projection (33) of a keeper lever (31) biased by a spring (35) to maintain the manually-operated pedal (12) and the holding rod (14) in a depressed position.

5. The door handle assembly of claim 1, wherein said holding rod (14) is adjustable in length by a connecting bolt (40).

* * * * *